US006293221B1

(12) United States Patent
Kinahan

(10) Patent No.: US 6,293,221 B1
(45) Date of Patent: Sep. 25, 2001

(54) APPARATUS FOR SUPPORTING A BANNER UNFURLED

(76) Inventor: Brian A. Kinahan, 49 Hickory Hill Rd., Simsbury, CT (US) 06070

( * ) Notice: Subject to any disclaimer, the term of this patent is extended or adjusted under 35 U.S.C. 154(b) by 0 days.

(21) Appl. No.: 09/146,598

(22) Filed: Sep. 3, 1998

(51) Int. Cl.[7] ..... G09F 17/00

(52) U.S. Cl. ..... 116/174; 116/173; 116/28 R; 40/591

(58) Field of Search ..... 116/173, 28 R, 116/174, 209; 40/591; 24/563, 545

(56) References Cited

U.S. PATENT DOCUMENTS

| | | | | |
|---|---|---|---|---|
| 1,002,260 | * | 9/1911 | Golden | 116/173 |
| 1,195,224 | | 8/1916 | Hoffman . | |
| 1,294,032 | * | 2/1919 | Bixby | 116/173 |
| 1,296,072 | * | 3/1919 | Gillespie | 116/173 |
| 2,072,573 | * | 3/1937 | Vigliotti | 116/173 |
| 2,168,484 | | 8/1939 | Loux . | |
| 2,368,783 | | 2/1945 | Schillinger . | |
| 2,764,122 | * | 9/1956 | Irvin | 116/173 |
| 2,856,891 | | 10/1958 | Solomon . | |
| 2,905,140 | | 9/1959 | Acklam . | |
| 2,909,147 | | 10/1959 | Crowder . | |
| 3,024,552 | * | 3/1962 | MacLea | 116/28 R |
| 3,075,492 | | 1/1963 | Winfrey . | |
| 3,495,568 | | 2/1970 | Palinkos . | |
| 3,636,912 | | 1/1972 | Kamp . | |
| 3,762,360 | * | 10/1973 | Hawes | 116/28 R |
| 4,024,833 | | 5/1997 | Pook et al. . | |
| 4,526,820 | | 7/1985 | Haas . | |
| 4,574,726 | * | 3/1986 | Sullivan | 116/28 R |
| 4,601,255 | | 7/1986 | Marcotti . | |
| 4,700,655 | | 10/1987 | Kirby . | |
| 4,875,431 | | 10/1989 | Dobosz . | |
| 5,042,418 | | 8/1991 | Hoover et al. . | |
| 5,267,524 | | 12/1993 | Maxwell . | |
| 5,402,746 | | 4/1995 | Deschamps . | |
| 5,517,941 | | 5/1996 | Fisher . | |
| 5,665,438 | | 9/1997 | Lee et al. . | |

* cited by examiner

*Primary Examiner*—Andrew H. Hirshfeld
(74) *Attorney, Agent, or Firm*—Cantor Colburn LLP

(57) ABSTRACT

A banner and support assembly for supporting a banner or flag to a vertical rod, such as a motor vehicle antenna, in an unfurled state at all times. The assembly includes a banner formed of cloth or other flexible material and a banner support for attaching the banner to the antenna. The banner has a vertical sleeve disposed at a side edge of the banner for receiving the antenna, and a vertical sleeve disposed at the upper edge of the banner for receiving the banner support. The banner support includes a vertical clip portion and a horizontal arm disposed at the upper end of the clip portion. The clip portion is generally C-shaped having an inner diameter less than the outer diameter of the antenna to receive the banner and antenna to frictionally clamp the banner to the antenna. The arm portion of the support extends through the vertical sleeve of the banner to maintain the banner in the unfurled state at all times. In the alternative the banner support may include a C-shaped clip and an L-shaped extension formed of flexible, formstable sheet material. The L-shaped member includes an arm that extends within the horizontal sleeve of the banner to maintain the banner in an unfurled state, yet allows the banner to naturally wave in the wind. The clip secures the banner and L-shaped member to the antenna.

6 Claims, 6 Drawing Sheets

APPARATUS FOR SUPPORTING A BANNER UNFURLED

FIELD OF THE INVENTION

The present invention relates to banners, and more particularly to an apparatus for supporting banners to a vertical rod, such as a motor vehicle antenna, in an unfurled state.

BACKGROUND OF THE INVENTION

Many type of devices are known in the art to display banners to an antenna of a motor vehicle. These banners may display indicia or symbols expressing one's support for a political candidate, personal cause or sports team. The banner may also include a flag of a particular nation or advertisement for a business. The prior art describes a number of devices for supporting and displaying such banners on an automobile antenna in a natural and unfirled state when the automobile is stationary.

For example, U.S. Pat. Nos. 2,909,147 to Crowder and 4,875,431 to Dobosz show flag attaching means for supporting a flag to a motor vehicle antenna. The attaching means includes a clip for securing the flag, made of cloth or other flexible sheet material, to the antenna. While the flag is free to wave in the wind to provide a natural display of the flag when the motor vehicle is moving or when the wind is blowing, the flexible flag does not remain in the unfurled state when no wind is present, resulting in the covering of the indicia or symbols imprinted on the flag.

Other examples for supporting pennants to an automobile antenna further include U.S. Pat. Nos. 2,905,140 to Acklam and 2,856,891 to Soloman. These pennants and support means overcome the disadvantage of the flag attaching means described hereinbefore by providing a flag or pennant formed of rigid material so that the indicia disposed on the pennant is readily visible at all times even when no wind is present. The pennants, however, appear as signs attached to the antenna rather than free waving flags.

U.S. Pat. Nos. 4,024,833 to Pook et al. and 4,700,655 to Kirby show a sign and flag support wherein the flag includes a vertical and upper horizontal sleeve for receiving a vertical rod and a horizontal rod, respectively. The rods display a cloth-like flag in an unfurled state at all times, however, the support apparatus is complex and unique, and therefore not easily transferrable to various vertical rods or antennas.

SUMMARY OF THE INVENTION

The invention offers advantages and alternatives over the prior art by providing a banner and banner support assembly having a banner support comprising a vertical clip portion and a horizontal arm portion for supporting and displaying a banner or flag to an antenna in an unfurled state at all times. The banner includes a horizontal sleeve at one edge of the banner for receiving the antenna, and a horizontal sleeve for receiving the horizontal arm portion of the support. Advantageously, the assembly may be easily clipped to an antenna in an unfurled state. The minimal support to maintain the banner in the unfurled state also allows the banner to be displayed in a substantially natural state, permitting the banner to wave in the wind. Further, the clip allows the banner assembly to the easily secured to the antenna at any desired height.

According to the present invention, a banner and support assembly for securing a banner to a vertical rod comprises a banner having a vertical sleeve disposed along an upper edge of the banner and a second sleeve disposed along a side edge. A banner support secures the banner to the vertical rod. The banner support includes a clip for clamping the banner to the vertical rod and an arm extending from an upper end of the clip. The arm extends through a predetermined portion of the second sleeve of the banner to consistently display the banner unfurled. Preferably the clip is generally C-shaped and frictionally engages the vertical rod. The arm may be integrally formed to the upper end of the clip. Alternatively, the arm may be form of a generally L-shaped wire having one end engaging the clip and a second end for supporting the upper edge of the banner. The banner support may comprise a clip and an arm formed of generally L-shaped flexible, formstable sheet material.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
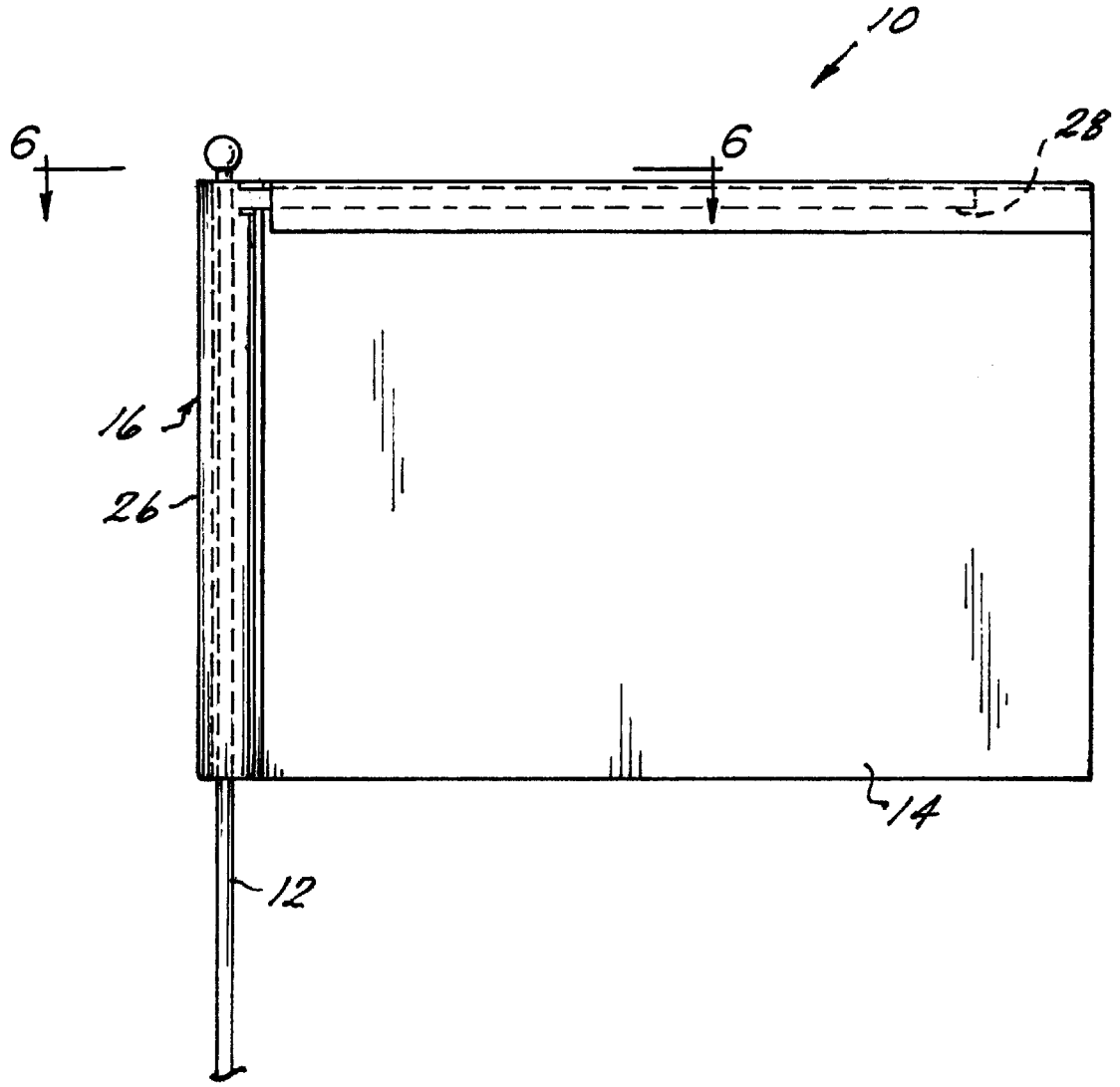
FIG. 1 shows a front elevational view of a banner and banner support assembly according to a preferred embodiment of the present invention attached to an antenna.
Figure 2:
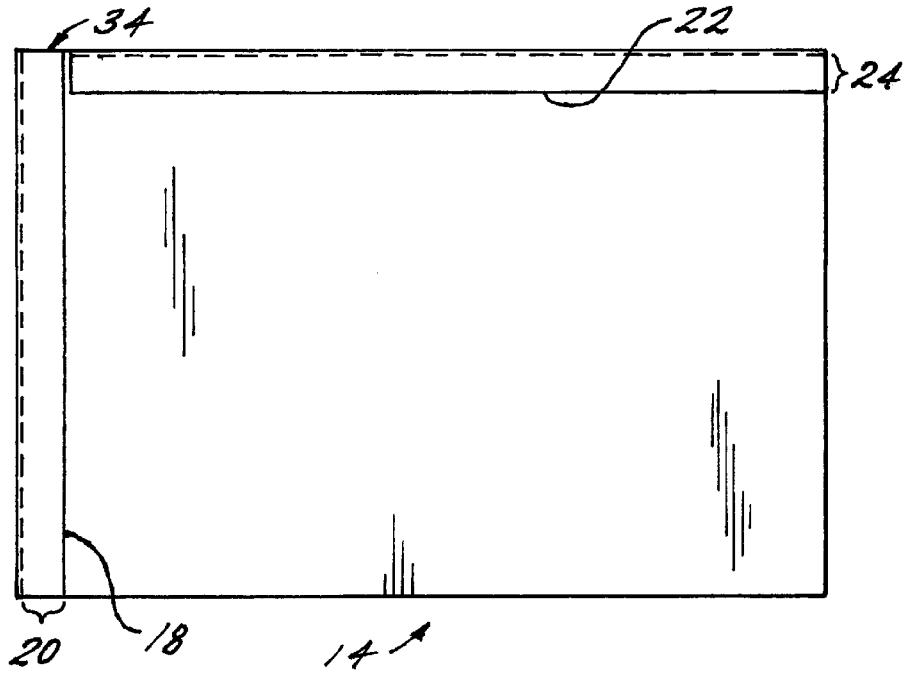
FIG. 2 shows a front elevational view of a banner of FIG. 1.

Referring to FIG. 1, a banner and support assembly, generally designated 10, is shown clipped to vertical rod 12 (i.e., an automobile antenna). The assembly 10 includes a banner or flag 14 and a banner support 16 for supporting the banner in an unfurled state at all times. As best shown in FIG. 2, the banner 14 has a generally rectangular shape having a side edge 18 of the banner 14 folded over and attached to the banner to form a vertical sleeve 20 for receiving the antenna 12. Further, a portion of the upper edge 22 of the banner 14 is folded inwardly and attached to the banner to form a horizontal sleeve 24 for receiving the support 16, as will be described in further detail hereinafter. While the banner 14 is shown generally rectangular, one will appreciate that the banner may be any shape (i.e., triangular)

provided the upper edge 22 of the banner includes the horizontal sleeve 24.

Figure 3:
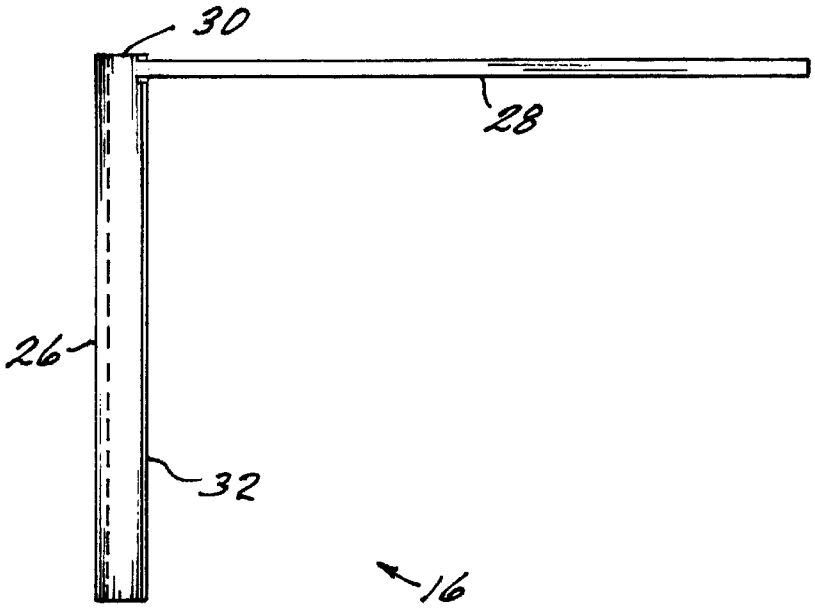
FIG. 3 shows a front elevational view of a banner support of FIG. 1.
Figure 4:
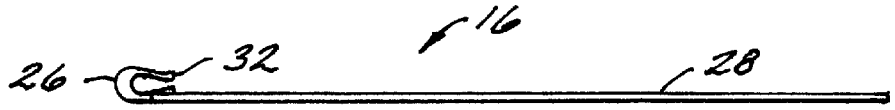
FIG. 4 shows a top plan view of the banner support of FIG. 3.
Figure 5:
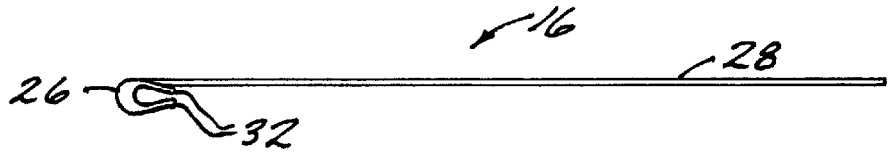
FIG. 5 shows a bottom plan view of the banner support of FIG. 3.

Referring to FIGS. 3–5, the banner support 16 includes a vertical clip portion 26 and an integral horizontal arm 28 extending from the upper end 30 of the clip portion. As best shown in FIGS. 4 and 5, the clip portion 26 is generally C-shaped for securing the banner 14 and the banner support 16 to the antenna 12. The outer ends 32 of the clip portion are flared outwardly to ease the insertion of the antenna 12 into the clip portion 26. The inner diameter of the clip portion is slightly less than the outer diameter of the antenna 12. The banner support 16 is formed of resilient flexible material, preferably polymeric material, to provide a clamping action to the antenna. The horizontal arm 28 extends sufficiently in the horizontal sleeve 24 of the banner 14 to ensure the banner is displayed unfurled.

Figure 6:
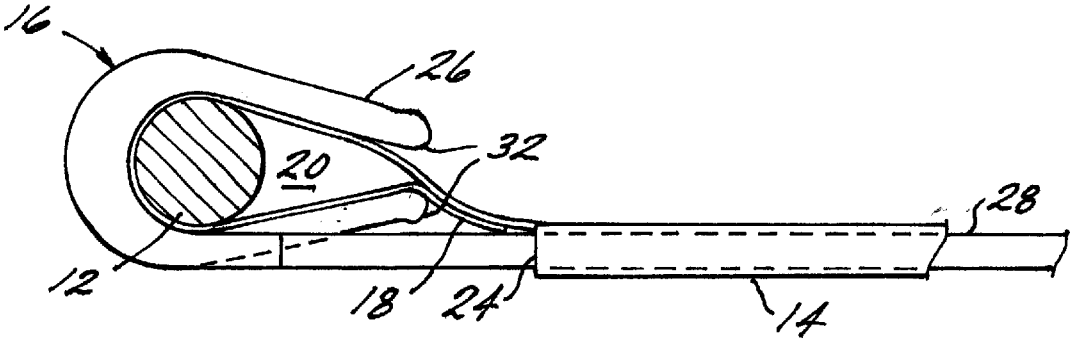
FIG. 6 shows a cross-sectional, top plan view of the banner and banner support assembly of FIG. 1 taken along the line 6—6.

In the assembly of the banner and support assembly 10, as shown in FIG. 6, the banner 14 is first fitted onto the antenna 12, whereby the antenna passes through the vertical sleeve 20. The upper end 34 (see FIG. 2) of the vertical sleeve 20 may be open to permit the antenna 12 to pass fully through the vertical sleeve, thus allowing the banner and support assembly 10 to be disposed at any desired height along the antenna. Further the opened ended vertical sleeve 20 permits a plurality of banners to be displayed on a single antenna. In the alternative, the upper end 34 of the vertical sleeve 20 may be closed to prevent the antenna from passing fully through the vertical sleeve, and thereby retain the banner and support assembly 10 at the top of the antenna 12. After the banner 14 is located at the desired height on the antenna 12, the horizontal arm 28 of the banner support 16 is inserted within the horizontal sleeve 24 of the banner 14. The horizontal arm 28 is fully inserted into the banner 14 until the curved ends 32 of the clip portion 26 of the banner support 16 engages the antenna 12 and vertical sleeve 20. The clip portion 26 of the support 16 is forced against the antenna 12 covered by the vertical sleeve 20, spreading the ends 32 of the clip portion apart to receive the antenna. The ends 32 of the resiliently flexible clip portion 26 then closes to frictionally clamp the banner 14 to the antenna 12.

Advantageously, the present invention provides a banner support 16 that displays the banner 14 in an unfurled state to permit display of the indicia or design on the banner whether the automobile is moving or stationary. The banner support 16 supports only one side edge 18 and the upper edge 22 of the banner 14 to thereby allow a substantial portion of the banner to wave in the wind, thus providing a natural display of the flag. Further, the banner support 16 enables the banner to be secured at any height along the antenna 12.

Figure 7:
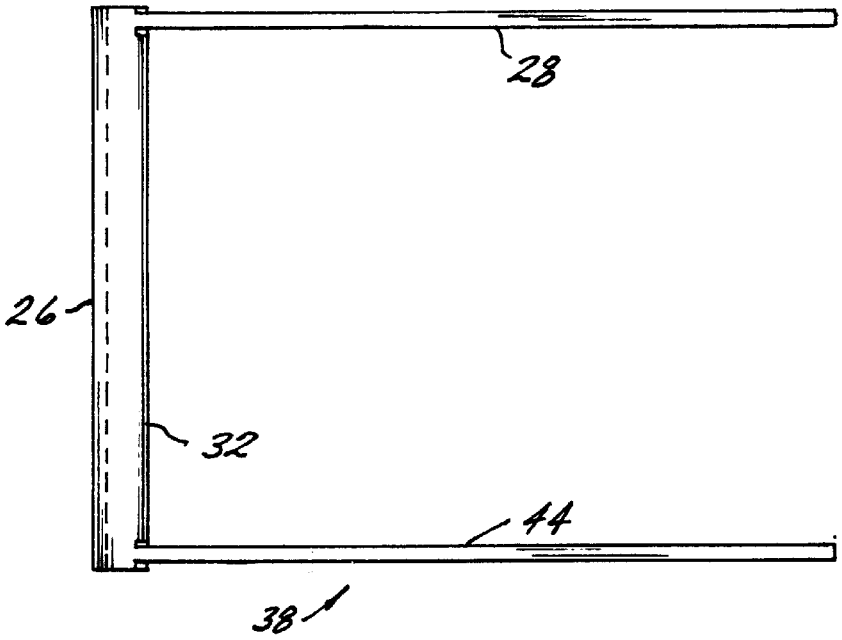
FIG. 7 shows a front plan view of an alternative embodiment of a banner support of FIG. 1.
Figure 8:
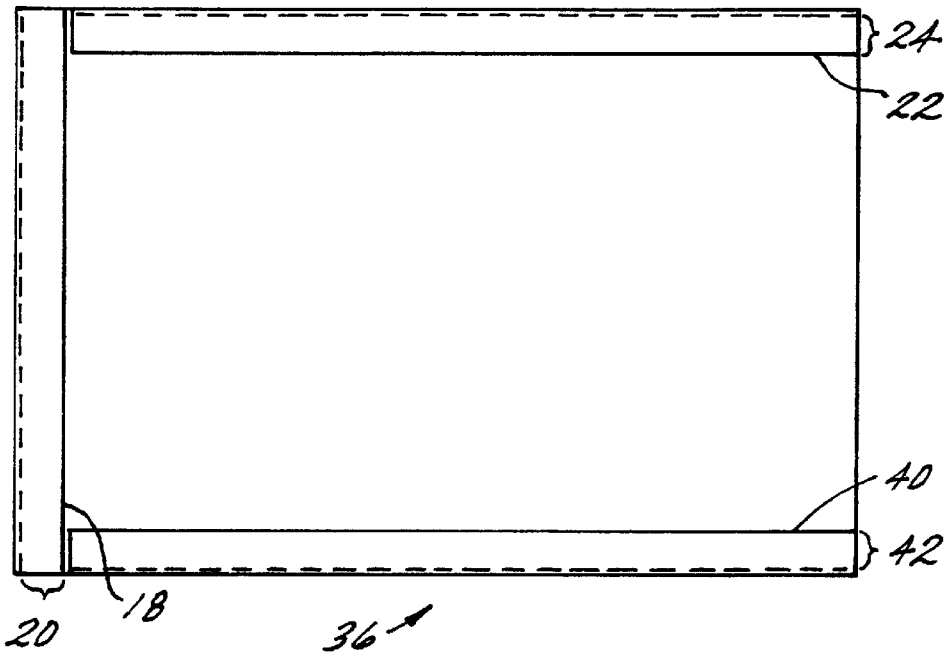
FIG. 8 shows a front plan view of an alternative embodiment of a banner of FIG. 1.

An alternative embodiment of the banner and banner support assembly 10 is shown in FIGS. 7 and 8. The banner 36 is substantially the same as the banner 14 of FIG. 2 and further includes a lower edge 40 folded inwardly and attached to the banner 36 to form a lower vertical sleeve 42. Further, the banner support 38 is substantially the same as the banner support 16 of FIG. 3, but further includes a second horizontal arm 44 extending from the lower end of the vertical clip portion 26. The lower horizontal arm 44 in the assembly of the banner 36 and support 38 is inserted within the lower horizontal sleeve 42 of the banner 36.

Figure 9:
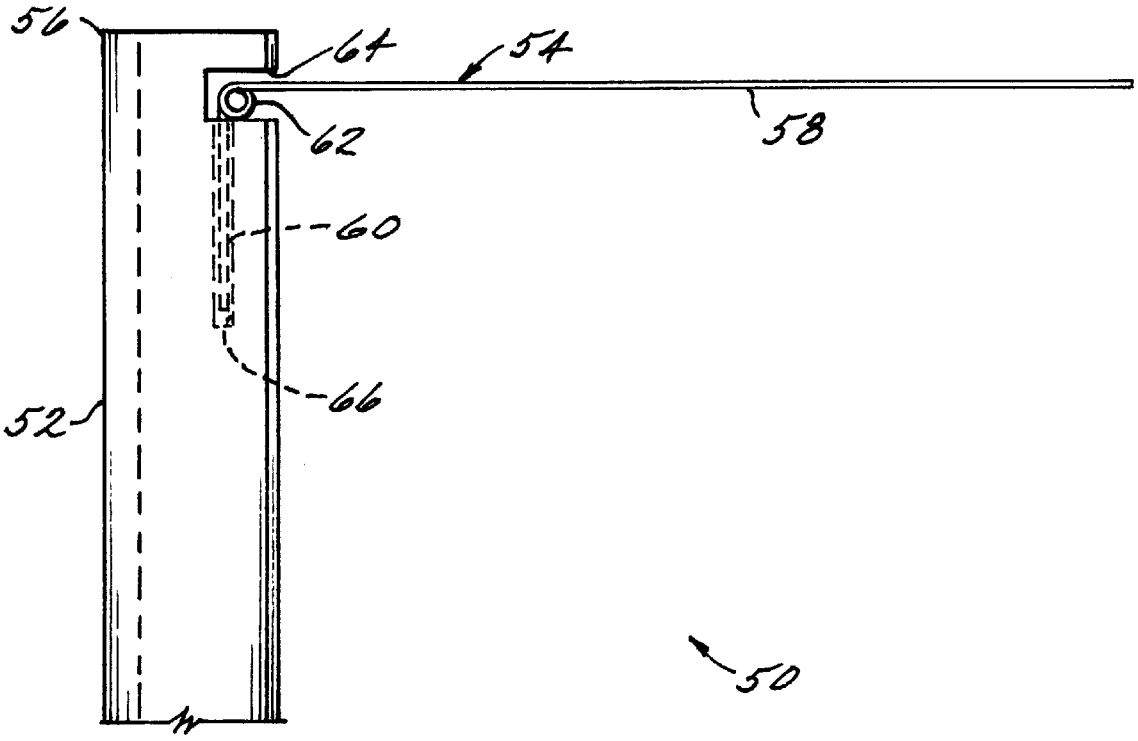
FIG. 9 shows a front plan view of a second alternative embodiment of a banner support of FIG. 1.

FIG. 9 illustrates an alternative embodiment of the banner support 16 for displaying the banner 14 of FIG. 2. The banner support 50 of FIG. 9 includes a horizontal clip 52, substantially similar to the clip portion 26 of the support 16 of FIG. 3, and an L-shaped wire 54 extending from the upper edge 56 of the clip. The wire 54 is formed by winding a wire a predetermined number of turns to form a vertical portion 58 and a horizontal portion 60, whereby a spring 62 is formed at the junction of the horizontal and vertical portions. The spring junction provides a spring action to the banner 14 secured to the horizontal portion 58 of the wire 54 to thereby permit the banner to more naturally move and wave in the wind. Further the spring 62 reduces the stress at the junction to increase the reliability and life of the banner support 54.

The L-shaped wire 54 is secured within a notch 64 disposed in the clip 52. The vertical portion 60 of the wire 54 is inserted within a bore 66 disposed longitudinally in a wall of the clip 52. The wire is free to rotate in the bore in the horizontal plane to further add to the natural action of the banner 14 in the wind.

Figure 10:
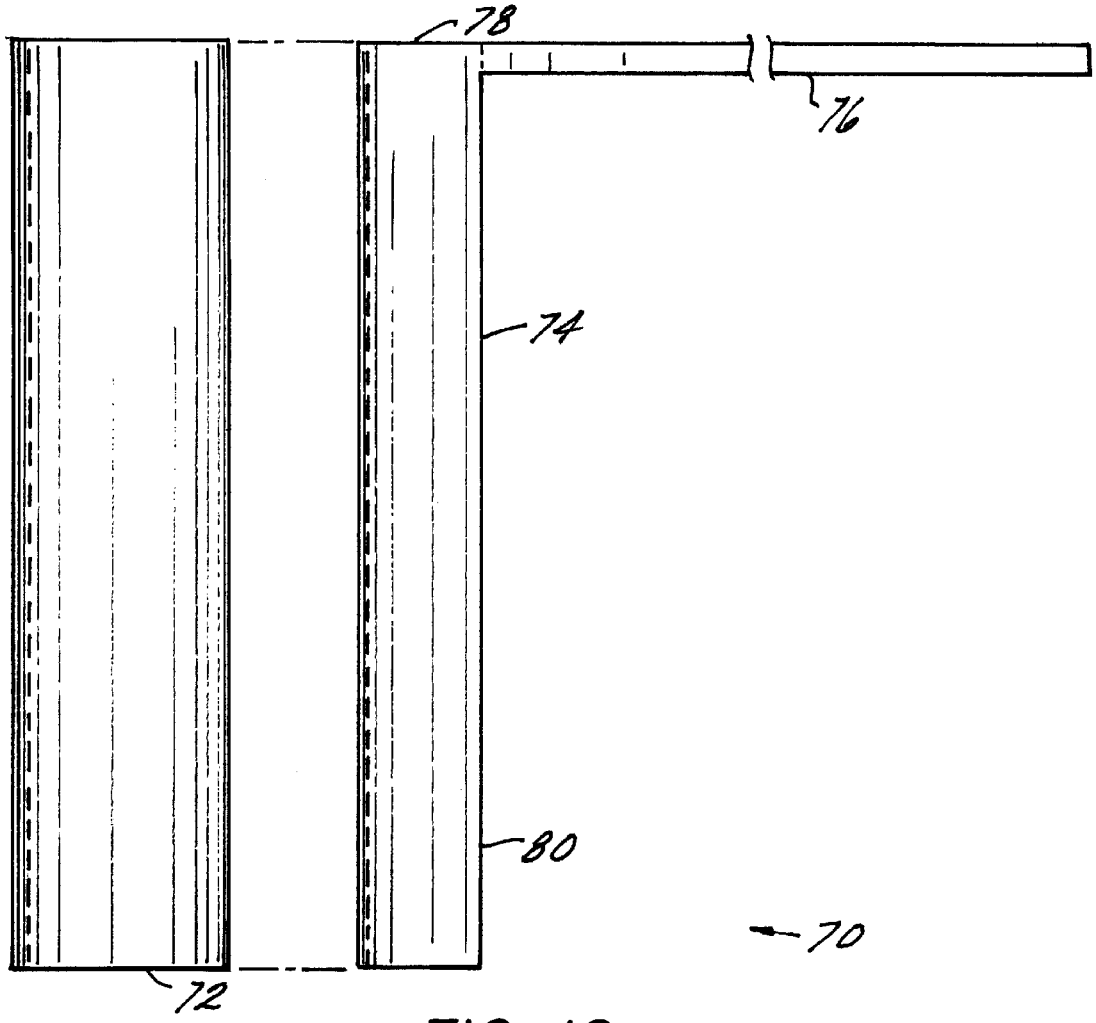
FIG. 10 shows an exploded, front elevational view of a third alternative embodiment of a banner support of the present invention.
Figure 11:
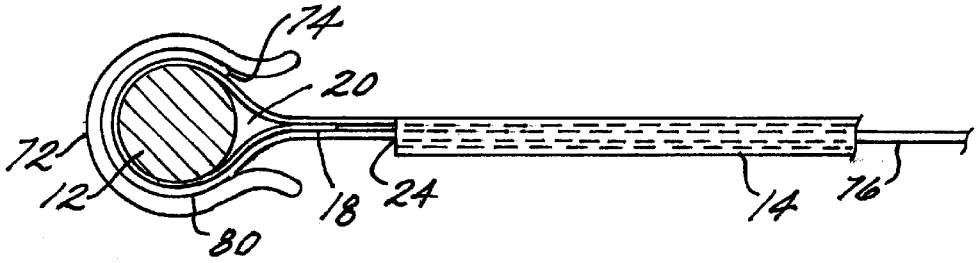
FIG. 11 shows a cross-sectional, top plan view of the third embodiment of the banner and banner support assembly of FIG. 1.

FIGS. 10 and 11 illustrate yet another alternative embodiment of the present invention for supporting and displaying the banner 14 of FIG. 1 in an unfurled state. Referring to FIG. 10, a banner support 70 includes a clip 72, similar to the clip portion 26 of the banner support 16 of FIG. 3, and a flexible formstable L-shaped extension 74 formed of flexible sheet material (i.e., polymeric sheet material). The L-shaped extension 74 includes a horizontal arm 76 extending from an upper end 78 of a vertical portion 80. Referring to FIG. 11, in the assembly of the banner 14 to the antenna, the banner is inserted onto the antenna 12 at the desired height. The horizontal arm 76 of the flexible L-shaped extension 74 is inserted fully into the upper sleeve 24 of the banner 14. The vertical portion 80 of the L-shaped extension is then wrapped around the vertical sleeve 20 of the banner 14 and the antenna 12. The clip 72 is then clamped over the vertical portion 80 of the extension 74 to secure the extension and the banner to the antenna. The flexible sheet material of the extension 74 provides sufficient support to maintained the banner 14 in an unfurled state, but sufficiently flexible to bent as the banner waves in the wind to provide a natural display of the banner.

While the banner and banner support assembly 10 of the present invention is shown attached to a vertical rod or antenna, one will appreciate that the assembly may be attached to an antenna disposed at varying angles.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An assembly comprising:

a banner;

a banner support; and a rod;

said banner having an upper edge and a side edge, said banner including a first sleeve at said side edge and a second sleeve at said upper edge;

said banner support having a clip for clamping said banner to the rod and an arm extending from an upper end of said clip, said arm extending through a predetermined portion of said second sleeve to consistently display the banner unfurled, wherein at least a portion of said clip at least partially surrounds said banner along at least a portion of said first sleeve;

said arm being a generally L-shaped wire having a first end within said second sleeve and a second end rotatably positioned within a vertically arranged bore in said clip.

2. The assembly, as defined in claim 1, wherein said banner is rectangular in shape.

3. The assembly, as defined in claim 1, wherein said banner is formed of flexible sheet material.

4. The assembly, as defined in claim 1, wherein said clip is generally C-shaped for frictionally engaging the rod.

5. The assembly, as defined in claim 1, wherein ends of said clip curve outwardly for assisting with the insertion of said clip onto the rod.

6. The assembly, as defined in claim 1, wherein said clip further includes a notch for retaining said wire within said clip.

* * * * *